US011712781B2

(12) United States Patent
Martin et al.

(10) Patent No.: US 11,712,781 B2
(45) Date of Patent: Aug. 1, 2023

(54) SURFACING SYSTEM FOR STEEL PLATE

(71) Applicant: Grip Tread, LLC, Columbus, OH (US)

(72) Inventors: Jerry Martin, Galena, OH (US); Jared Martin, Columbus, OH (US)

(73) Assignee: Grip Tread, LLC, Columbus, OH (US)

( * ) Notice: Subject to any disclaimer, the term of this patent is extended or adjusted under 35 U.S.C. 154(b) by 0 days.

(21) Appl. No.: 16/501,126

(22) Filed: Sep. 28, 2018

(65) Prior Publication Data

US 2020/0282423 A1 Sep. 10, 2020
US 2021/0114059 A9 Apr. 22, 2021

Related U.S. Application Data

(60) Provisional application No. 62/559,850, filed on Sep. 18, 2017.

(51) Int. Cl.

| | |
|---|---|
| ***B24C 1/04*** | (2006.01) |
| *B05D 3/02* | (2006.01) |
| *B05D 3/12* | (2006.01) |
| *B05D 5/02* | (2006.01) |

(52) U.S. Cl.
CPC ..... *B24C 1/04* (2013.01); *B05D 3/0254* (2013.01); *B05D 3/12* (2013.01); *B05D 5/02* (2013.01)

(58) Field of Classification Search
CPC ..... B05C 3/0254; B05C 3/12; B24C 1/04; B24C 1/06; B24C 1/00; B05D 5/00; B05D 5/02
See application file for complete search history.

(56) References Cited

U.S. PATENT DOCUMENTS

| | | | | |
|---|---|---|---|---|
| 2,330,365 | A * | 9/1943 | Jackson | B05D 7/16 428/454 |
| 4,618,511 | A * | 10/1986 | Molnar | C23C 4/12 118/500 |
| 5,480,498 | A * | 1/1996 | Beaudoin | C22F 1/04 148/698 |
| 5,716,412 | A * | 2/1998 | DeCarlo, Jr. | B23K 26/364 623/23.5 |
| 6,126,524 | A * | 10/2000 | Shepherd | B24C 1/00 451/75 |
| 6,502,442 | B2 | 1/2003 | Arola et al. | |
| 9,254,550 | B2 | 2/2016 | Haverty et al. | |
| 10,259,070 | B1 * | 4/2019 | Pfaff | B23K 10/00 |
| 2002/0018908 | A1 * | 2/2002 | Smith | E04F 11/16 52/177 |

(Continued)

FOREIGN PATENT DOCUMENTS

| | | | |
|---|---|---|---|
| JP | 2004212317 | A * | 7/2004 |
| JP | 2006265966 | A * | 10/2006 |

(Continued)

OTHER PUBLICATIONS

Pratt & Whitney Launches Purepulse™ Waterjey Technology, https://youtu.be/-p1LJo-IDcE, May 22, 2012, Huntsville, Ala USA.

(Continued)

*Primary Examiner* — Nathan H Empie
(74) *Attorney, Agent, or Firm* — Standley Law Group LLP; Jeffrey Norris

(57) ABSTRACT

The present disclosure relates to a surfacing system for manufacturing panels or other shapes that provide a non-slip surface that can be readily cleaned with common cleaning methods.

14 Claims, 3 Drawing Sheets

(56) References Cited

U.S. PATENT DOCUMENTS

| | | | | |
|---|---|---|---|---|
| 2006/0235536 | A1* | 10/2006 | Baliktay | A61F 2/36 623/18.11 |
| 2010/0015892 | A1* | 1/2010 | Vijay | B24C 3/32 451/36 |
| 2010/0211158 | A1* | 8/2010 | Haverty | B24C 1/10 623/1.15 |
| 2011/0104991 | A1* | 5/2011 | O'Donoghue | C23C 4/02 451/36 |
| 2011/0135877 | A1* | 6/2011 | Ullerich | B24C 11/00 428/141 |
| 2013/0213529 | A1* | 8/2013 | Kimura | C22C 38/24 148/507 |
| 2014/0295209 | A1* | 10/2014 | Yao | B24C 1/00 428/613 |

FOREIGN PATENT DOCUMENTS

| | | | |
|---|---|---|---|
| JP | 2009048923 | A * | 3/2009 |
| SU | 1237403 | A1 * | 6/1986 |

OTHER PUBLICATIONS

Daniels, et al., Abrasive-Entrained Forced Pulsed Waterjet Technique Basic Study, Aug. 21-23, 2005, pp. 1-15, Houston, Texas, USA.

* cited by examiner

SURFACING SYSTEM FOR STEEL PLATE

CROSS-REFERENCE TO RELATED APPLICATIONS

Not Applicable.

STATEMENT REGARDING FEDERAL GRANTS

Not Applicable.

BACKGROUND OF THE INVENTION

The present disclosure relates to a surfacing system for manufacturing panels or other shapes that provide a non-slip surface that can be readily cleaned with common cleaning methods.

Existing panel systems utilize a variety of non-slip surfaces, but in general many walkways and equipment access platforms are used where water or other spills are present and manufacturers are unsatisfied with both the price and performance of those non-skid surfaces.

These non-skid systems are generally unacceptable because of the difficulty in effectively cleaning the non-skid surface or if cleaned the reduction in the effectiveness of the non-skid surface over a period of time shorter than the service life of the associated equipment. In particular, there exist stringent cleanliness requirements within the food, dairy and beverage industries. Effective non-slip surfaces are essentially a requirement.

Other previous attempts in the food processing industry have offered a variety of surface treatments for non-slip surfaces, but each of which have certain limitations. For Example U.S. Pat. No. 6,502,442, filed May 11, 2001 (now expired) discloses a surface treatment system that uses water delivered with an abrasive. An abrasive water treatment method and apparatus includes supporting a metal workpiece and arranging a nozzle above a target surface with a nozzle is pointed towards the workpiece. A pressurized fluid having entrained abrasive particles is then generated and discharged through the nozzle and toward the target surface of the workpiece. In concept, the described process addresses a goal of the presently disclosed system, yet in operation the process was unable to effectively provide a non-slip surface, and was not commercially successful.

An improved non-slip system is desired by manufacturers and retrofitters to reduce the cost of current surface forms, and also the undesirable characteristics of such forms. It is also desirable to enable labor savings along with improved manufacturing processes, and maintenance. Improved non-slip surfaces are desired for in service reliability and durability.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

Disclosed herein is a new apparatus and associated method for manufacturing surfaced metallic plate that has been treated and modified so as to create a low skid surface and for passageways associated with other components. In particular, the surfaced panels are useful for in food processing or food surface locations where cleanliness is required.

As disclosed herein, essentially all of the surface treatments or "surface forms" suggested for use with planar panels will be applicable with minor modification to a variety of other shapes. As such the disclosed method is applicable to many shapes and materials. In essence, the disclosure provides a method of forming a shape comprising placing the shape in an apparatus for applying a surface form said apparatus movable about a variety of selectable positions apparatus having a delivery head for projecting pressurized forming composition towards the shape surface; the shape being annealed at an annealing temperature suitable for annealing the material of which the shape is formed; delivering the composition to the surface of the shape in a selected pattern; smoothing the surface form by delivering a composition from a second delivery head (whether the delivery head is a separate delivery head or the same delivery head delivering a different composition or a different pattern of composition; thereby forming a pattern of the surface of the shape that has properties for being non-slip or non-skid, and capable of being cleaned by a water based cleaning solution. The apparatus may comprise a computer controlled machine that applies a chosen surface form to a shape placed in the apparatus. The most common shape to be modified is a planar walkway, such as a steel sheet for use as a maintenance walkway or catwalk.

Figure 1:
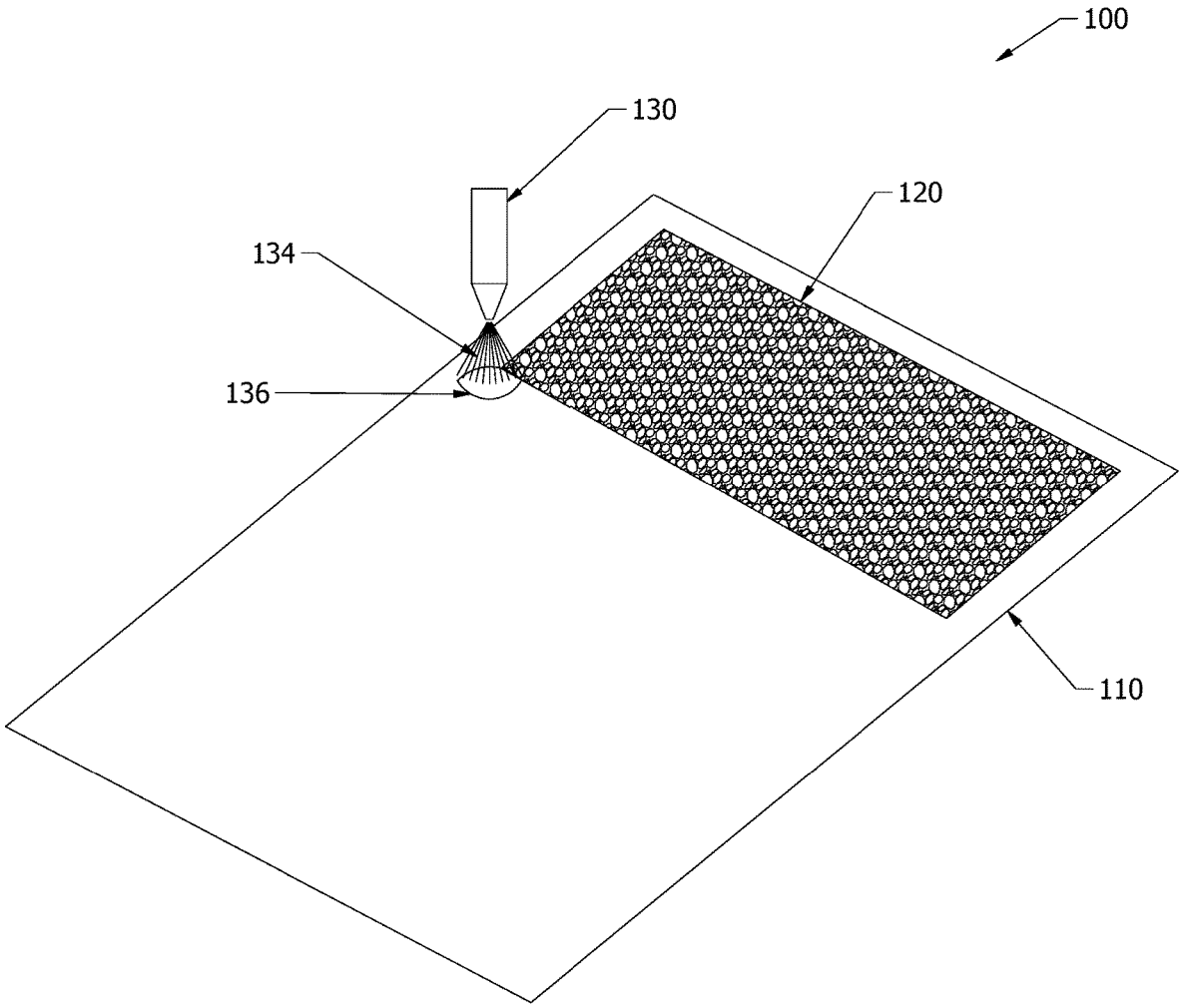
FIG. 1 shows a perspective view of the components of the manufacturing system.

FIG. 1 shows a perspective view of the components of the apparatus for forming a surface form as part of the present system. In one embodiment of the disclosure, the components of the disclosed system are an apparatus 100, typically in an enclosure, that holds the workpiece, such as panel 110, which could be a stainless steel sheet of 1 cm thickness or less. A series of surface treatment regions, 120, are applied by a delivery head 130 (which would be mounted to a control and support frame) that delivers a fluid, 134 in a pattern 136, to the surface of panel 110. As the delivery head 130 moves in a controlled fashion about the surface of panel 110, a series of surface forms are created on panel 110.

The panels as indicated in FIG. 1 are highly desirable in a number of locations, including locations where a surface, such as planar surface, is present in connection with equipment such as in conveyor installations, raised platform and catwalk installations in the vicinity of manufacturing equipment for instance, and in association with large tanks and repair platforms. Specific examples of such installations are in connection with food processing facilities such as product transfer stations, access platforms for piping assemblies, in association with specialty conveyors, skid mounted apparatus, and in relation to outdoor systems such as electrical enclosures, HVAC systems and similar equipment. In a particularly preferred embodiment the panels or shapes disclosed herein are desired where existing non-skid systems, such as diamond plate, expanded metal panels, and surface applications are an impediment to maintaining cleanliness, such as required in food processing applications.

Figure 2:
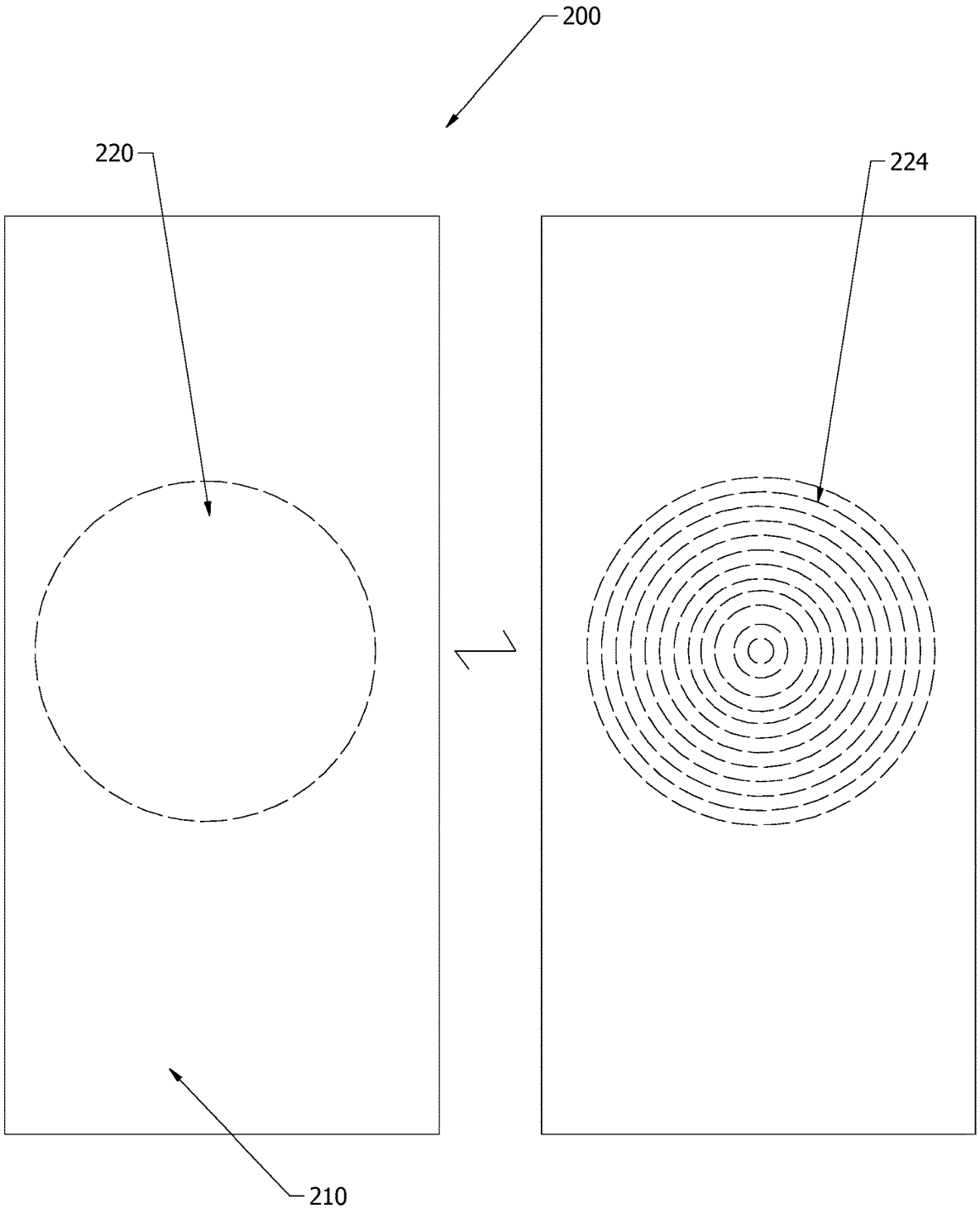
FIG. 2 shows a diagram of a surface form.

In FIG. 2, a detail of an exemplary diagram 200 of surface 210 is shown. Region 220 represents the re-selected location for application of a surface form, as indicated by the dotted ellipse. Following action of the delivery head (not shown) a surface form 224 is created on the surface of panel 210, in the zone 220. Control of the location of delivery head, such as delivery head 130 allows a selected pattern to be created on the surface of the work piece. In certain embodiments, the pattern is a series of circle, or ovals, a square, a diamond, a rectangle, or other polygon. In other embodiments, the pattern is formed in a graduated fashion, so that the surface form is most pronounced in the center of the polygonal region, such as region 224.

Figure 3:
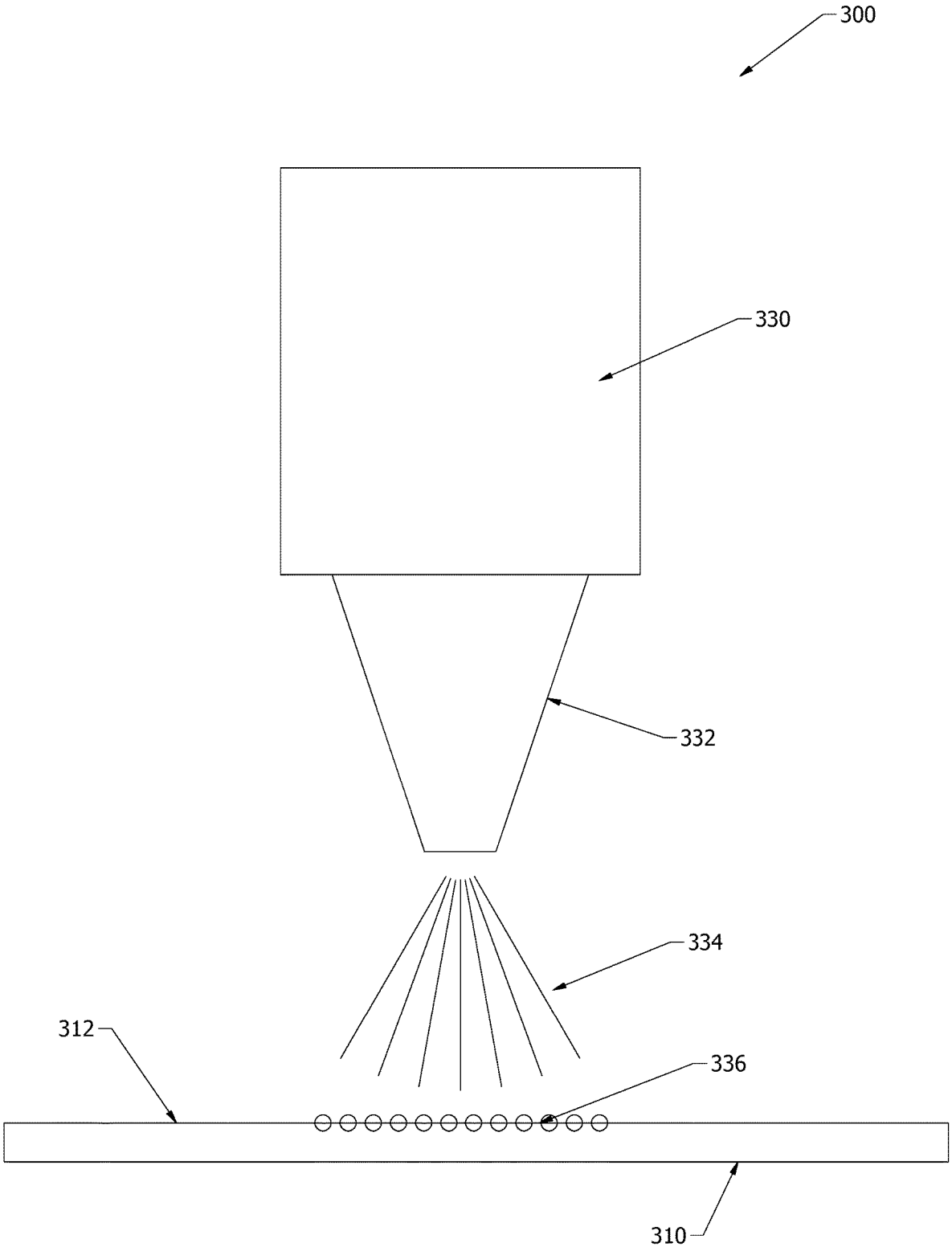
FIG. 3 shows a side view of a delivery head and plate.

FIG. 3 shows an example of a side view of the delivery head in association with a shape to which a surface form is created. It should be recognized that a preferred embodiment of the present system is that the surface form is created by reshaping or removing portions of the shape surface, so that the surface form does not wear off, or cannot be removed by common cleaning methods. When using a surface with the surface form as disclosed herein, the surface form is integrally part of the shape. In other embodiments, certain adjuncts could be applied at the same time or in association with the surface form. In one example, mild steel is modified with the non-skid surface form, and a powder coat, or this robust paint is applied, with the surface form telegraphing through to the bearing surface.

For most typical manufacturing methods and systems, the operation of the surface form processing occurs within an enclosure. Within the enclosure, in a preferred embodiment, a collecting outlet is provided as part of the enclosure. The delivery head that delivers the composition of liquid or mixture of liquid and solid can also include a number of forms of atomizers including atomizers that operate by means of high pressure, electrospray, a coaxial delivery siphon, or by means of ultrasound.

As shown in FIG. 3, apparatus 300 has a delivery head 330, which will be connected to a delivery pipe (not shown) such as a pipe for delivering high pressure treated water. Delivery head 330 is provided with one or more nozzles 332, with the nozzle delivering a composition containing liquid as at 334, such as water based composition with dissolved gases. The composition impacts against the upper surface 312 of plate 310, and creates a non-slip surface 336 in a pattern on the upper surface 312 of plate 310. Movement of the delivery head by the apparatus to a variety of selectable locations on the upper surface of the shape being modified (such as surface 312 of plate 310) creates a selected pattern on the surface of the shape.

Thus, disclosed is a surfaced metallic plate that has been treated and modified so as to create a low skid surface that is amenable to being effectively cleaned in food service food processing and clean production areas. Such surfaces are also intended for use wherever non-skid surfaces are desired.

The new plates described are also manufactured by use of a method of manufacture, where at least part or selected portions of the surface of an panel is modified using the method that comprises steps essentially consisting of providing an apparatus for holding the panel to be modified within an enclosure containing that portion of the panel surface to be modified. The modifying apparatus is in a preferred embodiment computer controlled, allowing for a selected pattern of surface modification to be applied. The apparatus has a delivery head that delivers a composition of liquid or mixture of liquid and solid within a predetermined pattern, such as a spray pattern. The apparatus moves the delivery head to those locations where application of the surface treatment is desired, and the delivery head ejects the high pressure composition against the panel surface. The collision of the composition against the panel creates an abraded surface with non-skid characteristics. In one embodiment, the composition is atomized by the application of ultrasonic frequency. In another embodiment, the composition is a combination of water and one or more of sand, beads, glass, carborundum, quartz, and flint.

As the delivery head moves about the panel, the surface of the panel is altered to possess a non-skid surface that is a series of circles, rectangles, squares or in a diamond patterns. In a preferred embodiment, the non skid surface is in a pattern, such as found in diamond plate panels, in expanded metal panels, or the like.

The described panels can be further embodied in a process where a sealant or other coating is applied to the surface. In a preferred embodiment, the panel is a stainless steel panel.

The composition delivered for creating the surface modification can further include a modifying or stabilizing gas, such as helium, argon, carbon dioxide or carbon monoxide, or gases such as halogen gas, nitrous oxide, sulphur dioxide, or hydrogen sulfide.

Further disclosed is a method of forming a surface form on a shape comprising placing the shape in an apparatus for applying a surface form said apparatus movable about a variety of selectable positions apparatus having a delivery head for projecting pressurized forming composition towards the shape surface; the shape being annealed at an annealing temperature suitable for annealing the material of which the shape is formed; delivering the composition to the surface of the shape in a selected pattern; smoothing the surface form by delivering a composition from a second delivery head (whether the delivery head is a separate delivery head or the same delivery head delivering a different composition or a different pattern of composition; thereby forming a pattern of the surface of the shape that has properties for being non-slip or non-skid, and capable of being cleaned by a water based cleaning solution.

The described method can be followed by a hardening treatment. A preferred shape is a plate formed of stainless steel, or other non-corroding metal. A further method is applying the surface form to a shape that has a three-dimensional surface, such as diamond plate or the like. Yet another embodiment is cooling the annealed shape to a reduced temperature than the annealing temperature, such as ambient temperature.

Yet another embodiment of the described method is forming a surface form on a series of shapes, such as a series of plates by competing the steps repeatedly in succession so that a continuous series of shapes or the same shape are successively formed in a continuous or semi-continuous series.

Additional benefits and features of the disclosed surface treatment system will be apparent to those skilled in the art.

While the invention has been described with reference to preferred embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Since certain changes may be made in the above system without departing from the scope of the invention herein involved, it is intended that all matter contained in the above descriptions and examples or shown in the accompanying drawings shall be interpreted as illustrative and not in a limiting sense. Also, all citations referred herein are expressly incorporated herein by reference. All terms not specifically defined herein are considered to be defined according to Webster's New Twentieth Century Dictionary Unabridged, Second Edition. The disclosures of all of the citations provided are being expressly incorporated herein by reference. The disclosed invention advances the state of the art and its many advantages include those described and claimed.

What is claimed:

1. A method of forming a surface form on a steel shape, comprising:

placing a steel shape in an apparatus for forming a surface form, said apparatus comprising a delivery head which is movable about a variety of selectable positions; projecting, from said delivery head, a composition under pressure and at ultrasonic frequency towards a surface of said shape, wherein said composition comprises water and a solid, and wherein said solid is selected from the group consisting of sand, beads, glass, carborundum, quartz, and flint;

delivering, by the projecting, said composition to said surface of said shape to abrade said surface in a selected and defined pattern such that material is removed from said surface to form said surface form, said pattern of said surface form comprising a continuous series of shapes selected from the group consisting of circles, ovals, squares, diamonds, rectangles, and other polygons; and smoothing said surface form by delivering a different pattern of said composition to said surface form or by delivering a different composition comprising water or a different liquid to said surface form;

wherein said surface form on said surface of said shape has properties for being non-slip or non-skid for walkways or equipment access platforms in the food, dairy, and beverage industries, and does not have an additional non-skid coating on said surface form to achieve said non-slip or non-skid properties, such that said surface form is capable of being cleaned by a water based cleaning solution without risk of removing an additional non-skid coating.

2. The method of claim 1 wherein said steel shape is annealed at an annealing temperature suitable for annealing a material of which said steel shape is formed.

3. The method of claim 1 wherein said smoothing step is performed by said delivery head.

4. The method of claim 1 wherein said smoothing step is performed by a different delivery head than said delivery head.

5. The method of claim 1 further comprising, after forming said surface form, the steps of:

moving said delivery head to at least one other selectable position for respectively forming said surface form at said at least one other selectable position; and delivering said composition to said surface of said shape to respectively abrade said surface in said selected and defined pattern such that material is removed from said surface to form said surface form at said at least one other selectable position;

wherein said smoothing step is performed after said surface form is respectively formed at said at least one other selectable position.

6. The method of claim 1 wherein said composition is atomized when delivered to said surface of said shape to form said surface form.

7. The method of claim 1 wherein said composition further comprises a gas selected from the group consisting of helium, argon, carbon dioxide, carbon monoxide, halogen gas, nitrous oxide, sulphur dioxide, and hydrogen sulfide.

8. The method of claim 1 wherein said surface is abraded in a graduated fashion to form said pattern, wherein said surface form is more pronounced in a portion of said surface form relative to another portion of said surface form.

9. A method of forming a surface form on a steel shape, comprising:

placing a steel shape in an apparatus for forming a surface form, said apparatus comprising a delivery head which is movable about a variety of selectable positions; projecting, from said delivery head, a composition under pressure and at ultrasonic frequency towards a surface of said shape, wherein said composition comprises water and a solid, and said solid is selected from the group consisting of sand, beads, glass, carborundum, quartz, and flint; and delivering, by the projecting, said composition to said surface of said shape to abrade said surface in a selected and defined pattern such that material is removed from said surface to form said surface form, said pattern of said surface form comprising a continuous series of shapes selected from the group consisting of circles, ovals, squares, diamonds, rectangles, and other polygons;

wherein said surface form on said surface of said shape has properties for being non-slip or non-skid for walkways or equipment access platforms in the food, dairy, and beverage industries, and does not have an additional non-skid coating on said surface form to achieve said non-slip or non-skid properties, such that said surface form is capable of being cleaned by a water based cleaning solution without risk of removing an additional non-skid coating.

10. The method of claim 9 wherein said steel shape is annealed at an annealing temperature suitable for annealing a material of which said steel shape is formed.

11. The method of claim 9 further comprising, after forming said surface form, the steps of:

moving said delivery head to at least one other selectable position for respectively forming said surface form at said at least one other selectable position; and delivering said composition to said surface of said shape to respectively abrade said surface in said selected and defined pattern such that material is removed from said surface to form said surface form at said at least one other selectable position.

12. The method of claim 9 wherein said composition is atomized when delivered to said surface of said shape to form said surface form.

13. The method of claim 9 wherein said composition further comprises a gas selected from the group consisting of helium, argon, carbon dioxide, carbon monoxide, halogen gas, nitrous oxide, sulphur dioxide, and hydrogen sulfide.

14. The method of claim 9 wherein said surface is abraded in a graduated fashion to form said pattern, wherein said surface form is more pronounced in a portion of said surface form relative to another portion of said surface form.

* * * * *